US010059900B2

(12) United States Patent
Ivancic et al.

(10) Patent No.: US 10,059,900 B2
(45) **Date of Patent: *Aug. 28, 2018**

(54) AMINOBENZOIC ACID DERIVATIVES

(71) Applicant: The Lubrizol Corporation, Wickliffe, OH (US)

(72) Inventors: Danielle N. Ivancic, Willoughby, OH (US); Patrick E. Mosier, Bay Village, OH (US); Ewan E. Delbridge, Concord Township, OH (US); Christopher L. Friend, Nottingham (GB)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/704,048

(22) Filed: Sep. 14, 2017

(65) Prior Publication Data

US 2018/0002629 A1 Jan. 4, 2018

Related U.S. Application Data

(63) Continuation of application No. 13/824,503, filed as application No. PCT/US2011/051670 on Sep. 15, 2011, now abandoned.

(60) Provisional application No. 61/384,393, filed on Sep. 20, 2010.

(51) Int. Cl.

| | |
|---|---|
| ***C10M 141/10*** | (2006.01) |
| ***C10M 133/08*** | (2006.01) |
| ***C10M 133/12*** | (2006.01) |
| ***C10M 133/14*** | (2006.01) |
| ***C10M 133/24*** | (2006.01) |

(52) U.S. Cl.

CPC ..... *C10M 133/12* (2013.01); *C10M 133/14* (2013.01); *C10M 133/24* (2013.01); *C10M 2215/06* (2013.01); *C10M 2215/16* (2013.01); *C10M 2219/06* (2013.01); *C10M 2219/062* (2013.01); *C10M 2223/045* (2013.01); *C10N 2230/36* (2013.01); *C10N 2230/40* (2013.01); *C10N 2230/42* (2013.01); *C10N 2230/43* (2013.01); *C10N 2230/45* (2013.01); *C10N 2230/52* (2013.01); *C10N 2240/10* (2013.01)

(58) Field of Classification Search

CPC ..... C10M 2223/045; C10M 2215/042
USPC ..... 508/500, 375
See application file for complete search history.

(56) References Cited

U.S. PATENT DOCUMENTS

| | | | | |
|---|---|---|---|---|
| 3,642,632 | A * | 2/1972 | Coburn | C10M 1/08 252/392 |
| 4,021,470 | A | 5/1977 | Braid | |
| 6,664,429 | B1 | 12/2003 | Huebner et al. | |
| 2006/0014653 | A1 | 1/2006 | Busse et al. | |
| 2008/0269087 | A1 * | 10/2008 | Psaila | C10M 125/10 508/171 |
| 2010/0160195 | A1 | 6/2010 | Cheng et al. | |

* cited by examiner

*Primary Examiner* — Vishal Vasisth
(74) *Attorney, Agent, or Firm* — Iken S. Sans; Christopher D. Hilker

(57) ABSTRACT

This invention relates to N-alkylated anthranilic acid derivative and their use in lubricants, such as engine oils, as TBN boosters. The invention particularly relates to compositions that deliver an ash-free base to a lubricant in the form of a basic amine additive, without adversely impacting seal compatibility and/or degradation, and methods thereof.

10 Claims, No Drawings

AMINOBENZOIC ACID DERIVATIVES

This application is a CON of Ser. No. 13/824,503, filed Mar. 18, 2013, now abandoned which is a 371 of PCT/US11/51670, filed Sep. 15, 2011 which claims benefit of 61/384,393, filed Sep. 20, 2010.

FIELD OF THE INVENTION

The invention relates to aminobenzoic acid derivatives, such N-alkylated anthranilic acid derivatives and similar materials, and their use in lubricants, such as engine oils. The invention particularly relates to delivering a basic amine to a lubricant while reducing and/or limiting detrimental effects commonly associated with basic amine additive containing lubricants, such as poor seal compatibility.

BACKGROUND OF THE INVENTION

It is known that lubricants become less effective during their use due to exposure to the operating conditions of the device they are used in, and particularly due to exposure to by-products generated by the operation of the device. For example, engine oil becomes less effective during its use, in part due to exposure of the oil to acidic and pro-oxidant byproducts. These byproducts result from the incomplete combustion of fuel in devices such as internal combustion engines, which utilize the oil. These byproducts lead to deleterious effects in the engine oil, and so, on the engine as well. The byproducts can oxidize hydrocarbons found in the lubricating oil, yielding carboxylic acids and other oxygenates. These oxidized and acidic hydrocarbons can then go on to cause corrosion, wear and deposit problems.

Base containing additives are added to lubricants in order to neutralize such byproducts, thus reducing the harm they cause to the lubricant, such as an engine oil, and so to the device, such as an engine. Over-based calcium or magnesium carbonate detergents have been used for some time as acid scavengers, neutralizing these byproducts and so protecting both the lubricant and the device. However, over-based phenate and sulfonate detergents carry with them an abundance of metal as measured by sulfated ash. New industry upgrades for diesel and passenger car lubricating oils are putting ever decreasing limits on the amount of sulfated ash, and by extension the amount of over-based detergent, permissible in an oil. A source of base that consists of only N, C, H, and O is extremely desirable.

Basic amine additives are an alternative to ash containing over-based metal detergents, in particular alkyl and aromatic amines. However, the addition of basic amine additives can lead to additional detrimental effects. For example, it is known that alkyl and some aromatic amines degrade fluoroelastomeric seals materials. These basic amine additives, such as succinimide dispersants, contain polyamine headgroups, which provide the source of base to the oil. However, such amines are believed to cause dehydrofluorination in fluoroelastomeric seals materials, such as Viton seals. This is a first step in seals degradation. Seal degradation leads to seal failure, such as seal leaks, which harms engine performance and also can cause engine damage. Generally, the base content, or total base number (TBN), of a lubricant can only be boosted modestly by such a basic amine before seals degradation becomes a significant issue, limiting the amount of TBN that can be provided by such additives.

There is a need for additives that deliver ash-free base to a lubricant without causing detrimental effects. In particular, there is need for basic amine additives that deliver ash-free base to engine oil without increasing seals degradation and/or impairing seal compatibility.

U.S. Pat. No. 2,390,943 relates to compositions comprising hydrocarbon oil and a combination of stabilizing ingredients.

U.S. Pat. Nos. 2,369,090 and 3,856,690 relate to lubricants which are stabilized against oxidative degradation.

U.S. Pat. No. 3,642,632 relates to lubricant compositions having improved resistance to deterioration under high performance conditions and is focused on gas turbine engines, such as turbojet, turboprop and turbofan engines.

It has now been discovered that derivatives of aminobenzoic acids, such as anthranilic acid, may be added to lubricants, such as engine oil, to deliver base. These additives surprisingly do not cause the harm to seal performance one skilled in the art would expect from such basic amine additives.

SUMMARY OF THE INVENTION

The present invention relates to aminobenzoic acid derivatives, including anthranilate esters, which may be used as lubricant additives. The additives of the present invention are basic amines that supply base to a lubricant without causing harm to seal performance. The present invention also relates to a method for neutralizing harmful acids with aminobenzoic acid derivatives as demonstrated by their ability to boost the TBN of fully formulated engine oils. It is known to those skilled in the art that some alkyl and aromatic amines degrade fluoroelastomeric seals material. Surprisingly, the basic amines of the current invention cause little to no harm to the seals material.

The invention provides a lubricating composition comprising (a) an oil of lubricating viscosity and (b) an additive of formula (I)

(I)

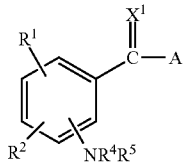

wherein $X^1$ is oxygen or sulfur; A is —$X^2$—$R^3$ or —$R^3$ where $X^2$ is oxygen or sulfur and $R^3$ is a hydrocarbyl group; $R^1$ and $R^2$ are each independently hydrogen, a hydrocarbon group, an alkoxy group, or linked together to form a hydrocarbyl ring; and wherein $R^4$ and $R^5$ are each independently: hydrogen; a hydrocarbyl group or a hydrocarbyl group linked together to form a hydrocarbyl ring; —$CH_2CH_2CN$; —$CH_2CH_2C(O)X^2R^6$ where $R^6$ is hydrogen or a hydrocarbyl group; or —$[CH_2CHR^7O]_y$—Z where $R^7$ is alkyl, y is from 0 to 50, and Z is hydrogen or a hydrocarbyl group. In some embodiments the additive is represented by the formula above with the added proviso that at least one of $R^4$ and $R^5$ is not hydrogen.

The invention provides a lubricating composition described above wherein (a), the oil of lubricating viscosity, has at least one property selected from the group consisting of: (i) a phosphorus content below 0.2% by weight, (ii) a sulfur content below 1% by weight, and (iii) a sulfated ash content below 1.5% by weight.

The invention further provides lubricating compositions as describe above wherein (b) is represented by formula (II)

(II)

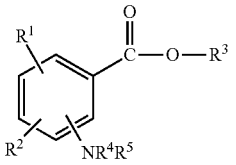

wherein $R^1$ and $R^2$ are each independently hydrogen, a hydrocarbon group, an alkoxy group, or linked together form a hydrocarbyl ring; $R^3$ is hydrogen or a hydrocarbon group; $R^4$ and $R^5$ are each independently hydrogen, a hydrocarbyl group, or linked together to form a hydrocarbyl ring. In some embodiments the additive is represented by the formula above with the added proviso that at least one of $R^4$ and $R^5$ is not hydrogen.

The invention provides for compositions containing the additive described herein, and optionally further comprising another detergent, where the TBN of the overall composition and/or the TBN delivered to the composition from the additive and the optional detergent, is greater than 6. The invention also provides for the use of the additive described herein as a TBN booster such that its addition boosts the TBN of the lubricating composition to which it is added by at least 1 mg KOH/g.

The invention also provides for any of the compositions described herein, where the hydrocarbyl group contained within the A group in any of the formulas herein contains a hydrocarbyl group containing at least 10 carbon atoms; a hydrocarbyl group containing at least one branch point; a fully saturated alkyl group; or combinations thereof.

The invention also provides for a method for preparing a lubricating composition comprising combining the components described above as well as a method of lubricating an internal combustion engine, comprising supplying to the engine the lubricating composition described above.

DETAILED DESCRIPTION

Various preferred features and embodiments will be described below by way of non-limiting illustration.

The Oil of Lubricating Viscosity

One component which is used in certain embodiments of the disclosed technology is an oil of lubricating viscosity, which can be present in a major amount, for a lubricant composition, or in a concentrate forming amount, for a concentrate. Suitable oils include natural and synthetic lubricating oils and mixtures thereof. In a fully formulated lubricant, the oil of lubricating viscosity is generally present in a major amount (i.e. an amount greater than 50 percent by weight). Typically, the oil of lubricating viscosity is present in an amount of 75 to 95 percent by weight, and often greater than 80 percent by weight of the composition.

Natural oils useful in making the inventive lubricants and functional fluids include animal oils and vegetable oils as well as mineral lubricating oils such as liquid petroleum oils and solvent-treated or acid-treated mineral lubricating oils of the paraffinic, naphthenic or mixed paraffinic/-naphthenic types which may be further refined by hydrocracking and hydrofinishing processes.

Synthetic lubricating oils include hydrocarbon oils and halo-substituted hydrocarbon oils such as polymerized and interpolymerized olefins, also known as polyalphaolefins; polyphenyls; alkylated diphenyl ethers; alkyl- or dialkylbenzenes; and alkylated diphenyl sulfides; and the derivatives, analogs and homologues thereof. Also included are alkylene oxide polymers and interpolymers and derivatives thereof, in which the terminal hydroxyl groups may have been modified by esterification or etherification. Also included are esters of dicarboxylic acids with a variety of alcohols, or esters made from C5 to C12 monocarboxylic acids and polyols or polyol ethers. Other synthetic oils include silicon-based oils, liquid esters of phosphorus-containing acids, and polymeric tetrahydrofurans.

Unrefined, refined and re-refined oils, either natural or synthetic, can be used in the lubricants of the present invention. Unrefined oils are those obtained directly from a natural or synthetic source without further purification treatment. Refined oils have been further treated in one or more purification steps to improve one or more properties. They can, for example, be hydrogenated, resulting in oils of improved stability against oxidation.

In one embodiment, the oil of lubricating viscosity is an API Group I, Group II, Group III, Group IV, or Group V oil, including a synthetic oil, or mixtures thereof. In another embodiment, the oil is Groups II, III, IV, or V. These are classifications established by the API Base Oil Interchangeability Guidelines. Group III oils contain <0.03 percent sulfur and >90 percent saturates and have a viscosity index of >120. Group II oils have a viscosity index of 80 to 120 and contain <0.03 percent sulfur and >90 percent saturates. Polyalphaolefins are categorized as Group IV. The oil can also be derived from the hydroisomerization of wax, such as slack wax or a Fischer-Tropsch synthesized wax. Such "Gas-to-Liquid" oils are typically characterized as Group III. Group V encompasses "all others".

In one embodiment, at least 50% by weight of the oil of lubricating viscosity is a polyalphaolefin (PAO). Typically, the polyalphaolefins are derived from monomers having from 4 to 30, or from 4 to 20, or from 6 to 16 carbon atoms. Examples of useful PAOs include those derived from 1-decene. These PAOs may have a viscosity of 1.5 to 150 $mm^2/s$ (cSt) at 100° C. PAOs are typically hydrogenated materials.

The oils of the present technology can encompass oils of a single viscosity range or a mixture of high viscosity range oils and low viscosity range oils. In one embodiment, the oil exhibits a 100° C. kinematic viscosity of 1 or 2 to 8 or 10 $mm^2/sec$ (cSt). The overall lubricant composition may be formulated using oil and other components such that the lubricant composition's viscosity at 100° C. is 1 or 1.5 to 10 or 15 or 20 $mm^2/sec$ and the Brookfield viscosity (ASTM-D-2983) at −40° C. is less than 20 or 15 Pa-s (20,000 cP or 15,000 cP), such as less than 10 Pa-s, even 5 or less.

In some embodiments, the compositions of the present invention have a phosphorus content below 0.2 percent by weight, a sulfur content equal to or below 1.0 percent by weight, and a sulfated ash content equal to or below 1.5 percent by weight, or some combination thereof. In some of these embodiments, the phosphorus content may be equal to or less than 0.15 or 0.12 or 0.1 percent by weight, the sulfur content may be equal to or less than 0.8 or 0.5 or 0.4 percent by weight, the sulfated ash content may be equal to or less than 1.3 or 1.0 or 0.5 percent by weight, or some combination thereof. In such embodiments the phosphorus content may be 0.1 or 0.08 or 0.06 percent by weight, or may be 0.02 to 0.06 or 0.08 percent by weight.

The Aminobenzoic Acid Derivatives

The present invention relates to aminobenzoic acid derivatives, such as anthranilate esters and similar additives, all of which are referred to herein as aminobenzoic acid derivatives and/or anthranilate esters. These additives may be used as lubricant additives and include those described by Formula (I):

(I)

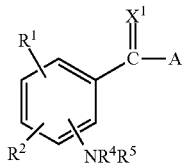

wherein $X^1$ is oxygen or sulfur; A is —$X^2$—$R^3$ or —$R^3$ where $X^2$ is oxygen or sulfur and $R^3$ is a hydrocarbyl group; $R^1$ and $R^2$ are each independently hydrogen, a hydrocarbon group, an alkoxy group, or linked together to form a hydrocarbyl ring; and wherein $R^4$ and $R^5$ are each independently: hydrogen; a hydrocarbyl group or linked together to form a hydrocarbyl ring; —$CH_2CH_2CN$; —$CH_2CH_2C(O)X^2R^6$ where $R^6$ is hydrogen or a hydrocarbyl group; or —$[CH_2CHR^7O]_y$—Z where $R^7$ is alkyl, y is from 0 to 50 or from 1 to 10, and Z is hydrogen or a hydrocarbyl group. In one or more of the embodiments described herein the additives are represented by the formula above with the added proviso that at least one of $R^4$ and $R^5$ is not hydrogen.

The hydrocarbyl groups provided above may each independently contain from 1 to 20 carbon atoms or from 1, 2, 4, 5 or 6 carbon atoms up to 20, 18, 16, 12, 10 or 8 carbon atoms.

In some embodiments the additives of the present invention are described by formula I above wherein $R^1$ and $R^2$ may also be a —R—OH group where R is a hydrocarbyl group, as defined above. In other embodiments $R^1$ and $R^2$ are substantially free, essentially free or even completely free of —R—OH groups.

In still other embodiments the additives of the present invention are described by the formula above wherein $X^1$ is oxygen or sulfur; A is —$X^2$—$R^3$ or —$R^3$ where $X^2$ is oxygen or sulfur and $R^3$ is a hydrocarbyl group; $R^1$ and $R^2$ are each independently hydrogen, a hydrocarbon group, an alkoxy group, or linked together to form a hydrocarbyl ring; and wherein $R^4$ and $R^5$ are each independently: hydrogen; a hydrocarbyl group; and a hydrocarbyl group linked together to form a hydrocarbyl ring, with the proviso that at least one of $R^4$ and $R^5$ is not hydrogen.

In any of the embodiments described above, the additives of the present invention may instead be represented by formula (II)

(II)

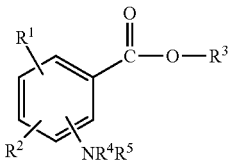

wherein $R^1$ and $R^2$ are each independently hydrogen, a hydrocarbon group, an alkoxy group, or linked together form a hydrocarbyl ring; $R^3$ is hydrogen or a hydrocarbon group; $R^4$ and $R^5$ are each independently hydrogen, a hydrocarbyl group, linked together to form a hydrocarbyl ring. In one or more of the embodiments described herein the additives are represented by the formula above with the added proviso that at least one of $R^4$ and $R^5$ is not hydrogen. In some embodiments $R^4$ and $R^5$ of the formula II may also include any of the groups defined above for formula I.

In still further embodiments, the additives of the present invention may instead be represented by formula (III)(a) or formula (III)(b):

(III)(a)

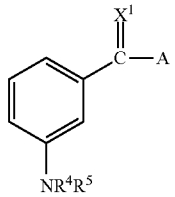

(III)(b)

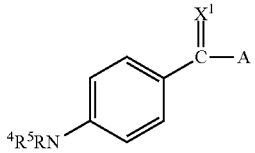

Wherein, for either formula, $X^1$ is oxygen or sulfur; A is —$X^2$—$R^3$ or —$R^3$ where $X^2$ is oxygen or sulfur and $R^3$ is a hydrocarbyl group; and $R^4$ and $R^5$ are each independently hydrogen, a hydrocarbyl group, or linked together to form a hydrocarbyl ring, optionally with the proviso that at least one of $R^4$ and $R^5$ is not hydrogen. Again, any of the definitions provided above for $R^4$ and $R^5$ may also, in some embodiments, apply here as well.

In any of the embodiments described above $R^3$ may be: (i) a hydrocarbyl group containing at least 10 carbon atoms; (ii) a hydrocarbyl group containing at least one branch point; (iii) a fully saturated alkyl group; or (iv) any combination of one or more embodiments thereof.

In some embodiments the additives of the present invention are derived from a 4-(dialkylamino)benzoic acid and/or a 4-(alkylamino)benzoic acid by reacting the acid with an alcohol, optionally in the presence of a catalyst. Examples of suitable acids include but are not limited to 4-(dimethylamino)benzoic acid, 4-(diethylamino)benzoic acid, 4-(dipropylamino)benzoic acid, 4-(methylamino)benzoic acid, 4-(ethylamino)benzoic acid, 4-(propylamino)benzoic acid, or any combination thereof. In other embodiments the additives of the present invention are derived from a 3-(dialkylamino)benzoic acid and/or a 3-(alkylamino)benzoic acid by reacting the acid with an alcohol, optionally in the presence of a catalyst. Examples of suitable acids include but are not limited to 3-(dimethylamino)benzoic acid, 3-(diethyl amino)benzoic acid, 3-(dipropylamino)benzoic acid, 3-(methylamino)benzoic acid, 3-(ethyl amino)benzoic acid, 3-(propylamino)benzoic acid, or any combination thereof.

In other embodiments, the additive may be described as the reaction product of an alcohol and an alkylated aminobenzoic acid.

The reaction of the alcohol and the aminobenzoic acid may be carried out in the presence of a basic catalyst, such as NaOH.

Suitable alcohols may be described by the formula $R^3$—OH where $R^3$ is a hydrocarbyl group as defined above. In some embodiments the alcohol and/or the $R^3$ group in the alcohol is chosen to impart oil solubility to the ester product.

In some embodiments the alcohol used to prepare the additive is: a mixture of linear alcohols where the alcohols may contain 1 to 4, 2 to 10, 3 to 6, or 8 to 10 carbon atoms.

In some embodiments the alcohol used to prepare the additive is: decyl alcohol; tridecyl alcohol, optionally with one or more branch points such as isotridecyl alcohol and 2,4,6,8-tetramethyl-nonanol; 2-ethylhexanol; or combinations thereof. In other embodiments, the alcohol used may contain 1-24, 2 to 18, 4 to 14 or 6 to 12 carbon atoms and any of the alcohols listed herein may be used in combination with one another.

In some embodiments the alcohol used to prepare the additive is: 2,4,6,8-tetramethyl-nonanol, a mixture of linear alcohols where the alcohols may contain 8 to 10 carbon atoms, 2-ethylhexanol, or combinations thereof. In still other embodiments, the alcohol used is 2,4,6,8-tetramethyl-nonanol, a mixture of linear alcohols where the alcohols may contain 8 to 10 carbon atoms, or combinations thereof. In still other embodiments, the additive is derived from 2,4,6,8-tetramethyl-nonanol.

The aminobenzoic acid derived additives of the invention may be present in the lubricating compositions in amounts that deliver specific amounts of TBN, as described below. In other embodiments, used in combination with any of the embodiments described above, the additive may be present in a lubricating composition at 0.5, 1.0, 1.2 or 2.0 percent by weight or more. In still other embodiments, the additive is present within a range having a lower limit of 0.5, 1.0, 1.2 or 2.0 percent by weight and an upper limit of 3.0, 4.0, 4.5 or 5.0 percent by weight.

Additional Additives

In some embodiments, the compositions of the present invention contain one or more additional additives. A suitable additional additive is a detergent, where the detergent is different from the anthranilate ester additive described above.

Most conventional detergents used in the field of engine lubrication, unlike those of the present technology, obtain most or all of their basicity or TBN from the presence of basic metal-containing compounds (metal hydroxides, oxides, or carbonates, typically based on such metals as calcium, magnesium, or sodium). Such metallic overbased detergents, also referred to as overbased or superbased salts, are generally single phase, homogeneous Newtonian systems characterized by a metal content in excess of that which would be present for neutralization according to the stoichiometry of the metal and the particular acidic organic compound reacted with the metal. The overbased materials are typically prepared by reacting an acidic material (typically an inorganic acid or lower carboxylic acid such as carbon dioxide) with a mixture of an acidic organic compound (also referred to as a substrate), a stoichiometric excess of a metal base, typically in a reaction medium of an one inert, organic solvent (e.g., mineral oil, naphtha, toluene, xylene) for the acidic organic substrate. Typically also a small amount of promoter such as a phenol or alcohol is present, and in some cases a small amount of water. The acidic organic substrate will normally have a sufficient number of carbon atoms to provide a degree of solubility in oil.

Such conventional overbased materials and their methods of preparation are well known to those skilled in the art. Patents describing techniques for making basic metallic salts of sulfonic acids, carboxylic acids, phenols, phosphonic acids, and mixtures of any two or more of these include U.S. Pat. Nos. 2,501,731; 2,616,905; 2,616,911; 2,616,925; 2,777,874; 3,256,186; 3,384,585; 3,365,396; 3,320,162; 3,318,809; 3,488,284; and 3,629,109. Salixarate detergents are described in U.S. Pat. No. 6,200,936.

Such conventional detergents may be used in the compositions of the present invention in combination with the anthranilate ester additives described above. However, in some embodiments the use of the anthranilate ester additives allows for a reduced need for such conventional nitrogen-containing additives without creating the detrimental effects they usually bring, for example increased seal degradation.

Additional conventional components may be used in preparing a lubricant according to the present invention, for instance, those additives typically employed in a crankcase lubricant. Crankcase lubricants may contain any or all of the following components hereinafter described.

Another additive is a dispersant. Dispersants are well known in the field of lubricants and include primarily what is known as ashless-type dispersants and polymeric dispersants. Ashless type dispersants are characterized by a polar group attached to a relatively high molecular weight hydrocarbon chain. Typical ashless dispersants include nitrogen-containing dispersants such as N-substituted long chain alkenyl succinimides, also known as succinimide dispersants. Succinimide dispersants are more fully described in U.S. Pat. Nos. 4,234,435 and 3,172,892. Another class of ashless dispersant is high molecular weight esters, prepared by reaction of a hydrocarbyl acylating agent and a polyhydric aliphatic alcohol such as glycerol, pentaerythritol, or sorbitol. Such materials are described in more detail in U.S. Pat. No. 3,381,022. Another class of ashless dispersant is Mannich bases. These are materials which are formed by the condensation of a higher molecular weight, alkyl substituted phenol, an alkylene polyamine, and an aldehyde such as formaldehyde and are described in more detail in U.S. Pat. No. 3,634,515. Other dispersants include polymeric dispersant additives, which are generally hydrocarbon-based polymers which contain polar functionality to impart dispersancy characteristics to the polymer. Dispersants can also be post-treated by reaction with any of a variety of agents. Among these are urea, thiourea, dimercaptothiadiazoles, carbon disulfide, aldehydes, ketones, carboxylic acids, hydrocarbon-substituted succinic anhydrides, nitriles, epoxides, boron compounds, and phosphorus compounds. References detailing such treatment are listed in U.S. Pat. No. 4,654,403. The amount of dispersant in the present composition can typically be 1 to 10 weight percent, or 1.5 to 9.0 percent, or 2.0 to 8.0 percent, all expressed on an oil-free basis.

Another component is an antioxidant. Antioxidants encompass phenolic antioxidants, which may comprise a butyl substituted phenol containing 2 or 3 t-butyl groups. The para position may also be occupied by a hydrocarbyl group or a group bridging two aromatic rings. The latter antioxidants are described in greater detail in U.S. Pat. No. 6,559,105. Antioxidants also include aromatic amines, such as nonylated diphenylamine. Other antioxidants include sulfurized olefins, titanium compounds, and molybdenum compounds. U.S. Pat. No. 4,285,822, for instance, discloses lubricating oil compositions containing a molybdenum and sulfur containing composition. Typical amounts of antioxidants will, of course, depend on the specific antioxidant and its individual effectiveness, but illustrative total amounts can be 0.01 to 5, or 0.15 to 4.5, or 0.2 to 4 percent by weight. Additionally, more than one antioxidant may be present, and certain combinations of these can be synergistic in their combined overall effect.

Viscosity improvers (also sometimes referred to as viscosity index improvers or viscosity modifiers) may be included in the compositions of this invention. Viscosity improvers are usually polymers, including polyisobutenes, polymethacrylates (PMA) and polymethacrylic acid esters, hydrogenated diene polymers, polyalkylstyrenes, esterified styrene-maleic anhydride copolymers, hydrogenated alkenylarene-conjugated diene copolymers and polyolefins. PMA's are prepared from mixtures of methacrylate monomers having different alkyl groups. The alkyl groups may be either straight chain or branched chain groups containing from 1 to 18 carbon atoms. Most PMA's are viscosity modifiers as well as pour point depressants.

Multifunctional viscosity improvers, which also have dispersant and/or antioxidancy properties are known and may optionally be used. Dispersant viscosity modifiers (DVM) are one example of such multifunctional additives. DVM are typically prepared by copolymerizing a small amount of a nitrogen-containing monomer with alkyl methacrylates, resulting in an additive with some combination of dispersancy, viscosity modification, pour point depressancy and dispersancy. Vinyl pyridine, N-vinyl pyrrolidone and N,N'-dimethylaminoethyl methacrylate are examples of nitrogen-containing monomers. Polyacrylates obtained from the polymerization or copolymerization of one or more alkyl acrylates also are useful as viscosity modifiers.

Another additive is an antiwear agent. Examples of antiwear agents include phosphorus-containing antiwear/extreme pressure agents such as metal thiophosphates, phosphoric acid esters and salts thereof, phosphorus-containing carboxylic acids, esters, ethers, and amides; and phosphites. In certain embodiments a phosphorus antiwear agent may be present in an amount to deliver 0.01 to 0.2 or 0.015 to 0.15 or 0.02 to 0.1 or 0.025 to 0.08 percent by weight phosphorus. Often the antiwear agent is a zinc dialkyldithiophosphate (ZDP). For a typical ZDP, which may contain 11 percent P (calculated on an oil free basis), suitable amounts may include 0.09 to 0.82 percent by weight. Non-phosphorus-containing anti-wear agents include borate esters (including borated epoxides), dithiocarbamate compounds, molybdenum-containing compounds, and sulfurized olefins.

Other additives that may optionally be used in lubricating oils include pour point depressing agents, extreme pressure agents, color stabilizers and anti-foam agents. One or metal-containing detergents, as described above, may also be included.

The foregoing lubricating oil additives may be added directly to the base oil to form the lubricating oil composition. In one embodiment, however, one or more of the additives may be diluted with a substantially inert, normally liquid organic diluent such as mineral oil, synthetic oil, naphtha, alkylated (e.g., $C_{10}$-$C_{13}$ alkyl) benzene, toluene or xylene to form an additive concentrate. These concentrates may contain from about 1 to about 99 percent by weight, and in one embodiment from about 10 to 90 percent by weight of such diluent. The concentrates may be added to the base oil to form the lubricating oil composition.

In some embodiments the lubricating compositions of the present invention comprise at least one additive selected from the group consisting of non-phosphorus-containing anti-wear agents, ashless dispersants, antioxidants, friction modifiers, zinc dithiophosphates, and corrosion inhibitors.

The lubricating compositions of the present invention may have an overall TBN of greater than 6, a TBN of 7, 8, 9, 10 or greater. In still other embodiments the lubricating compositions of the present invention also have a sulfated ash content of less than 1.5, 1.3 or 1.0 percent by weight. In some embodiments, the TBN delivered by the anthranilate ester additive, alone or in combination with a conventional detergent additive, represents a TBN of at least 1, 2, 3, or 4 of the overall TBN of the lubricating composition. That is to say, the additive of the present invention may be used as a TBN booster and can be added to a lubricating composition to increase the overall TBN of that composition. In such embodiments, the anthranilate ester additives of the present invention may increase the TBN of the compositions to which they are added by 1, 2, 3, 4, 5 or more units. In some embodiments, the anthranilate ester additives are present in an amount sufficient to boost the TBN of the overall composition to which it is added by 1 to 6 units, 1 to 5 units, or 2 to 4 units.

The present invention provides a surprising ability to provide relatively high TBN while maintaining the low sulfated ash levels, and other limitations, required by increasingly stringent government regulations while at the same time protecting seal performance and compatibility.

The lubricating compositions of the present invention may have a nitrogen content of less than 0.4 or 0.3 percent by weight and/or a soap content of less than 5 or 3 percent by weight.

The lubricant described herein may be used to lubricate a mechanical device, by supplying the lubricant to the device, and in particular to the moving parts. The device may be an internal combustion engine (ICE), a driveline component (e.g., automatic or manual transmission, gear box, differential). The ICE that may be lubricated may include gasoline fueled engines, spark ignited engines, diesel engines, compression ignited engines, two-stroke cycle engines, four-stroke cycle engines, sump-lubricated engines, fuel-lubricated engines, natural gas-fueled engines, marine diesel engines, and stationary engines. The vehicles in which such ICE may be employed include automobiles, trucks, off-road vehicles, marine vehicles, motorcycles, all-terrain vehicles, and snowmobiles. In one embodiment, the ICE is a heavy duty diesel engine, which may include sump-lubricated, two- or four-stroke cycle engines, which are known to those skilled in the art.

In some embodiments the lubricating compositions defined herein contain component (b), the additive component, such that the additive boosts the TBN of overall composition by at least 1 mg KOH/g; and optionally, results in a sulfated ash content of the composition is less than or equal to 1.0% by weight. In addition, in some embodiments the lubricating compositions defined herein contain component has one or more of the following properties: (i) the nitrogen content of the composition is less than 0.4, 0.2, 0.1, 0.05 or even 0.01 percent by weight, (ii) the soap content of the composition is less than 5, 4, 2, 1 or even 0.5 percent by weight, or (iii) combinations thereof.

Specific Embodiment

The invention will be further illustrated by the following examples, which sets forth particularly advantageous embodiments. While the examples are provided to illustrate the invention, they are not intended to limit it.

Example 1-A: Synthesis of 4-(dimethylamino)benzoic Acid Decyl Ester

A one-liter, four-necked, round-bottom flask, equipped with an overhead stirrer, sub-surface gas inlet tube, thermowell, Dean-Stark trap, and Friedrick's condenser, is charged with 316.3 grams (2.00 moles) of 1-decanol and 30 grams of solid Amberlyst-15 catalyst. The flask is purged with nitrogen and warmed to 120 degrees C. before 165 grams (1.00 mole) of 4-(dimethylamino)benzoic acid is added portion-wise over 10 minutes. Evolved water is condensed in the Dean-Stark trap. The mixture is stirred at 150 degrees C. for 6 hours and filtered hot using 50 grams of Fax-5 to remove any particulates. The filtrate is reheated to 150 degrees C. for 1 hr under vacuum (<40 mmHg) to remove excess alcohol. The mixture is cooled to yield the desired product, in the form of a brown liquid.

Example 1-B: Synthesis of 4-(dimethylamino)benzoic Acid Decyl Ester

A One-Liter, four-necked, round-bottom flask, equipped with an overhead stirrer, sub-surface gas inlet tube, thermowell, and Friedrick's condenser, is charged with 200.0 grams (1.26 moles) of 1-decanol and 3.34 grams (24.3 mmoles) of solid potassium carbonate. The flask is purged with nitrogen and warmed to 120 degrees C. before 179 grams (1.00 mole) of 4-(dimethylamino)benzoic acid methyl ester is added portion-wise over 10 minutes. The mixture is stirred at 150 degrees C. for 6 hours and filtered hot using 50 grams of Fax-5 to remove any particulates. The filtrate is reheated to 150 degrees C. for 1 hr under vacuum (<40 mmHg) to remove excess alcohol. The mixture is cooled to yield the desired product, in the form of a brown liquid.

Example 2: Synthesis of 4-(dimethylamino)benzoic Acid 2-ethylhexyl Ester

A one liter, four necked, round bottom flask, equipped with an overhead stirrer, sub-surface gas inlet tube, thermowell, and Friedrick's condenser, is charged with 200.0 grams (1.53 moles) of 2-ethylhexanol and 3.34 grams (24.3 mmoles) of solid potassium carbonate. The flask is purged with nitrogen and warmed to 120 degrees C. before 179 grams (1.00 mole) of 4-(dimethylamino)benzoic acid methyl ester is added portion-wise over 10 minutes. The mixture is stirred at 150 degrees C. for 6 hours and filtered hot using 50 grams of Fax-5 to remove any particulates. The filtrate is reheated to 150 degrees C. for 1 hr under vacuum (<40 mmHg) to remove excess alcohol. The mixture is cooled to yield the desired product, in the form of a brown liquid.

Example 3: Synthesis of 2-(3-butoxy-3-oxopropylamino)benzoic Acid Decyl Ester

A one-liter, four-necked, round-bottom flask, equipped with an overhead stirrer, sub-surface gas inlet tube, thermowell, and Friedrick's condenser, is charged with 277 grams (1.00 mole) of 2-aminobenzoic acid decyl ester and 128 grams (1.00 mole) of butyl acrylate. The flask is purged with nitrogen and warmed to 85 degrees C. for 6 hours and filtered hot using 50 grams of FAX-5. The mixture is cooled to yield the desired product, in the form of a brown liquid.

Example 4: Synthesis of 2-(2-hydroxypropylamino)benzoic Acid Decyl Ester

A Parr reactor vessel, equipped with a stirrer, is charged with 277 grams (1.00 mole) of 2-aminobenzoic acid decyl ester, 87.1 grams (1.50 mole) of propylene oxide and 0.60 grams (10 mmole) of acetic acid. The reactor vessel is sealed and heated to 110 degrees C. for 4 hours. Upon cooling, the mixture is filtered through 50 grams of FAX-5 to yield the desired product, in the form of a brown liquid.

In this specification the terms "hydrocarbyl substituent" or "hydrocarbyl group," as used herein are used in its ordinary sense, which is well-known to those skilled in the art. Specifically, it refers to a group primarily composed of carbon and hydrogen atoms and is attached to the remainder of the molecule through a carbon atom and does not exclude the presence of other atoms or groups in a proportion insufficient to detract from the molecule having a predominantly hydrocarbon character. In general, no more than two, preferably no more than one, non-hydrocarbon substituent will be present for every ten carbon atoms in the hydrocarbyl group; typically, there will be no non-hydrocarbon substituents in the hydrocarbyl group. A more detailed definition of the terms "hydrocarbyl substituent" or "hydrocarbyl group," is described in U.S. Pat. No. 6,583,092.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, all percent values listed herein are on a weight basis. Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent, which may be customarily present in the commercial material, unless otherwise indicated. It is to be understood that the upper and lower amount, range, and ratio limits set forth herein may be independently combined. Similarly, the ranges and amounts for each element of the invention can be used together with ranges or amounts for any of the other elements. As used herein, the expression "consisting essentially of" permits the inclusion of substances that do not materially affect the basic and novel characteristics of the composition under consideration.

What is claimed is:

1. A method of lubricating a two- or four-stroke cycle internal combustion engine, comprising supplying to said two- or four-stroke cycle engine a lubricating composition having a sulfated ash content of 1% or less and comprising (a) an oil of lubricating viscosity and (b) an additive of formula (III)(a):

(III)(a)

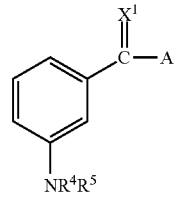

wherein, $X^1$ is oxygen or sulfur; A is —$X^2$—$R^3$ or —$R^3$ where $X^2$ is oxygen or sulfur and $R^3$ is a hydrocarbyl group containing more than 10 and up to 20 carbon atoms; and wherein $R^4$ and $R^5$ are each independently: hydrogen; a hydrocarbyl group; or linked together to form a hydrocarbyl ring; with the proviso that at least one of $R^4$ and $R^5$ is not hydrogen; wherein (b) is present in an amount to boost the TBN of said lubricating composition by at least 1 mg KOH/g such that said lubricating composition has a TBN of at least 6; and (c) a metal-containing detergent.

2. The method of claim 1 wherein (a), the oil of lubricating viscosity, has at least one property selected from the group consisting of: (i) a phosphorus content below 0.2% by weight, (ii) a sulfur content below 1% by weight, and (iii) a sulfated ash content below 1.5% by weight.

3. The method of claim 1 wherein: (i) the nitrogen content of the composition is less than 0.4 percent by weight, (ii) the soap content of the composition is less than 5 percent by weight, or (iii) combinations thereof.

4. The method of claim 1 wherein $R^3$ is: (i) a hydrocarbyl group containing at least 10 carbon atoms; (ii) a hydrocarbyl group containing at least one branch point; or (iv) combinations thereof.

5. The method of claim 4 wherein $R^3$ is: (i) a hydrocarbyl group containing at least 10 carbon atoms.

6. The method of claim 1 wherein component (b) is derived from a 4-(dialkylamino)benzoic acid and an alcohol, optionally in the presence of a catalyst.

7. The method of claim 1 wherein component (b) is derived from an alcohol component comprising a mixture of linear alcohols containing 1 to 4 carbon atoms, a mixture of linear alcohols containing 2 to 10 carbon atoms, a mixture of linear alcohols containing 3 to 6 carbon atoms, a mixture of linear alcohols containing 8 to 10 carbon atoms, decyl alcohol, isotridecyl alcohol, 2-ethylhexanol, or combinations thereof.

8. The method of claim 1 further comprising at least one additive selected from the group consisting of non-phosphorus-containing anti-wear agents, ashless dispersants, antioxidants, friction modifiers, zinc dithiophosphates, dispersant viscosity modifiers and corrosion inhibitors.

9. The method of claim 1, wherein said oil of lubricating viscosity is at least one of an API Group I oil, Group II oil, Group III oil, or mixtures thereof and wherein said oil is present in an amount greater than 50% percent by weight of a total weight of said lubricating composition.

10. The method of claim 1, wherein the additive (b) is present at 0.5 to 2.0 percent by weight, based on a total weight of the lubricating composition.

* * * * *